United States Patent [19]

Funk et al.

[11] Patent Number: 4,961,026

[45] Date of Patent: Oct. 2, 1990

[54] PROXIMITY FOCUSED IMAGE INTENSIFIER HAVING A GLASS SPACER RING BETWEEN A PHOTOCATHODE AND A FLUORESCENT SCREEN DISK

[75] Inventors: Hans W. Funk, Hirschberg; Kurt Frank, Darmstadt; Bernd Engel, Grosse-Gerau, all of Fed. Rep. of Germany

[73] Assignee: Proxitronic Funk GmbH & Co. KG, Bensheim, Fed. Rep. of Germany

[21] Appl. No.: 306,442

[22] Filed: Feb. 3, 1989

[30] Foreign Application Priority Data

Feb. 13, 1988 [DE] Fed. Rep. of Germany ..... 3804516

[51] Int. Cl.[5] ..... H01J 43/28

[52] U.S. Cl. ..... 313/525; 313/526; 313/544; 313/292

[58] Field of Search ..... 313/523, 525, 526, 541, 313/544, 292

[56] References Cited

U.S. PATENT DOCUMENTS 4,293,790 10/1981 Funk et al. ..... 313/101

4,724,357 2/1988 Drinkwine ..... 313/526 X

FOREIGN PATENT DOCUMENTS 2652070 5/1978 Fed. Rep. of Germany .

OTHER PUBLICATIONS

Nahfokus-Bildwandler und-Bildverstarker-von Dr.rer. nat. Kurt Frank, Weiterstadft, 1/82.

*Primary Examiner*—Kenneth Wieder

*Attorney, Agent, or Firm*—Milde & Robinson

[57] ABSTRACT

In an image intensifier comprising an evacuated vessel with a first disk which forms an input window and on whose inner surface a photocathode is disposed, and with a second disk which forms an output window and on whose inner surface a fluorescent screen is disposed. The spacing between the first and second disks is small in relation to the diameter of the image intensifier. The input and output windows are plane-parallel, and a spacer ring is disposed between the first and second disks whose inside diameter increases from the area of the first disk in the direction of the second disk. The spacer ring is spaced at its inside diameter as close as possible to the first disk.

28 Claims, 2 Drawing Sheets

PROXIMITY FOCUSED IMAGE INTENSIFIER HAVING A GLASS SPACER RING BETWEEN A PHOTOCATHODE AND A FLUORESCENT SCREEN DISK

BACKGROUND OF THE INVENTION

The invention relates to an image intensifier comprising an evacuated vessel with a first disk which forms an input window and on whose inner surface a photocathode is disposed, and with a second disk which forms an output window and on whose inner surface a fluorescent screen is disposed, the spacing between the first and second disks being small in relation to the diameter of the image intensifier, the input and output windows being plane-parallel, and a spacer ring being disposed between the first and second disks whose inside diameter increases from the area of the first disk in the direction of the second disk.

Image intensifiers of this type, known as proximity-focused intensifiers or intensifier diodes, are distinguished by simplicity of construction, freedom from distortion of the image on the fluorescent screen, and, with a sufficiently high accelerating voltage and minimal spacing between photocathode and fluorescent screen, by good resolution that is uniform over the entire useful surface area.

The requirement for a high accelerating voltage and a minimal spacing between photocathode and fluorescent screen signifies high field strengths within the image intensifier, for the control of which various measures have already come to be known. For example, it is known to provide between the disks carrying the photocathode and the fluorescent screen a spacer ring whose inside diameter increases from the photocathode toward the disk carrying the fluorescent screen. (German Patent No. 26 52 070; *Feinwerktechnik und Messtechnik*, 1982, No. 2, pp. 59–61.) As a result, electrons released by accidental events at the interior walls of the image intensifier will not have an avalanche effect on the wall of the inner ring. Also, provision is made for all points on the inner surface of the spacer ring to be at a specific potential. To this end, the spacer ring is either fabricated from an electronically conducting glass or provided with an electrically weakly conducting surface.

SUMMARY OF THE INVENTION

A principal object of the present invention is to make possible a further improvement to the known proximity-focused image intensifiers, and, more particularly, to allow the use of as high an accelerating voltage as possible in smaller image intensifiers.

This object, as well as other objects which will become apparent from the discussion that follows, are achieved, according to the present invention, by positioning the spacer ring at its inside diameter as close as possible to the first disk.

In an advantageous refinement, the face of the spacer ring directed toward the first disk is provided with an electrically conducting layer. This measure provides assurance that the potential at the inner edge of the spacer ring which faces the cathode is equal to the cathode potential, which in turn results in a steady decrease of the potential at the inner surface of the spacer ring between the photocathode and the disk carrying the fluorescent screen.

In a further refinement of the invention, the inner surface of the first disk is plane at least within a circle formed by the inner edge of the spacer ring.

The invention is based on the realization that the gap due to the indium ring between the photocathode-carrying disk and the spacer ring in the previously known proximity-focused image intensifiers imposes a limit on the use of voltages that are as high as possible. In the image intensifier according to the invention, in contrast, provision is made for permitting the voltage to drop over as large a segment of the inner surface of the spacer ring as possible, with the voltage drop setting in already in the direct vicinity of the photocathode plane. This has the advantage that the electric field between the photocathode and the fluorescent screen is influenced in the peripheral regions to a lesser degree than in the prior-art proximity-focused image intensifiers by unsteadiness of the field strength between the photocathode or its contact electrode and the inner edge of the spacer ring on the photocathode side.

In accordance with still another refinement of the invention, it is particularly advantageous to provide at the periphery of the spacer-ring face directed toward the first disk an indium ring for uniting the spacer ring with the first disk. This is made possible in particular by the fact that the gap between the spacer ring and the first disk decreases from the exterior to the interior, preferably approximately linearly. However, it is also possible to provide a peripheral shoulder which assures that there is room for the indium ring even though in the inner region of the spacer ring the gap between it and the first disk is kept small.

A further possibility of securing a small gap is to have the spacer-ring face directed toward the first disk extend substantially plane-parallel to the photocathode; locate an indium ring in a peripheral groove in the spacer-ring face; unite the first disk in its peripheral region with a metal flange comprising an annular edge which axially projects beyond the plane of the photocathode; and to press or sink the edge of the metal flange into the indium ring.

Image intensifiers whose input sensitivity is in a spectral region different from that of the output image are also called image converters. For the sake of simplicity, the term image intensifier is here applied to both. The inventive measures are applicable regardless of the spectral regions involved in a given case.

Preferred embodiments of the invention are illustrated in several figures of the accompanying drawings and will now be described in detail.

DESCRIPTION OF THE PREFERRED EMBODIMENTS

Figure 1:
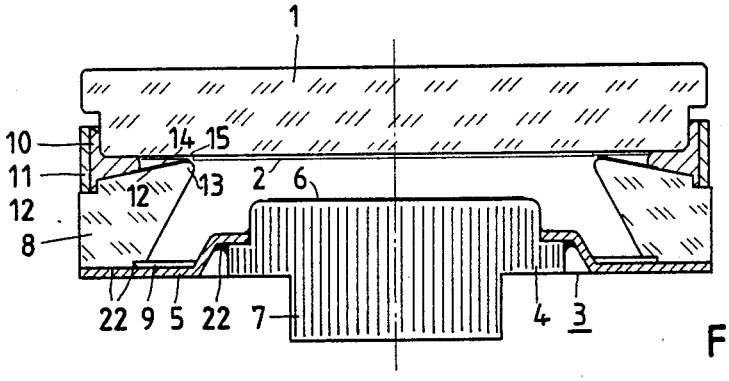
FIG. 1 is a longitudinal section through a first preferred embodiment of the present invention.
Figure 2:
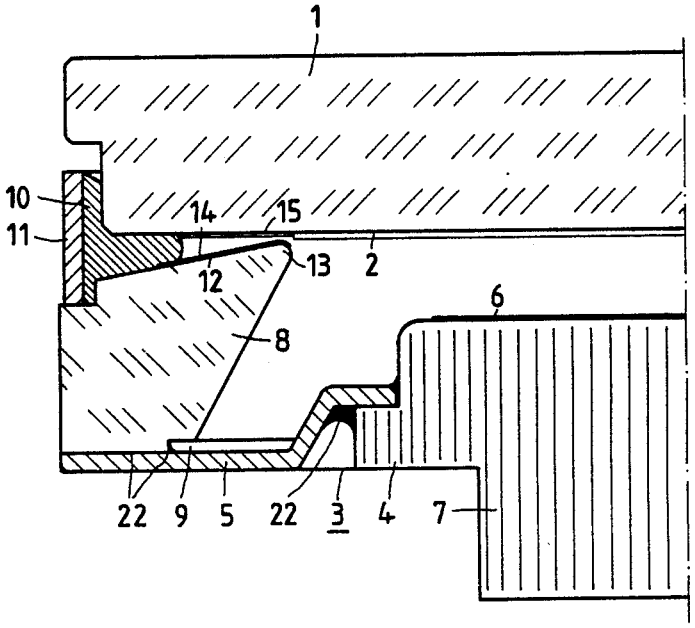
FIG. 2 shows a portion of the embodiment illustrated in FIG. 2 on an enlarged scale.

The preferred embodiments of the present invention will now be described with reference to FIGS. 1–4 of the drawings. Identical elements in the various figures are identified by the same reference numerals.

The image intensifier of FIG. 1 comprises an evacuated vessel with a first disk 1 which forms an input window and carries a photocathode 2. Depending on the end use of the image intensifier, the first disk 1 may be made of a material that matches the desired spectral region and is high-vacuum-resistant, radio-transparent and photocathode-compatible.

A second disk 3 comprises a glass body 4 and, soldered onto it, a metal flange 5. The glass body 4 is in the form of a fiberglass disk and carries a fluorescent screen 6. The use of a fiberglass disk permits the image intensifier to be coupled directly to another image intensifier, to a television camera tube or to a semiconductor image sensor (charge-coupled imager). In the embodiment illustrated, the fiberglass disk 4 is provided in the proximity of the image area with a projection 7 to adapt it to the constructional features of a semiconductor image sensor.

The first and second disks 1 and 3 are joined to each other by means of a spacer ring 8, also made of glass. The joint between the spacer ring 8 and the metal flange 5, and between the glass body 4 and the metal flange 5, is made with a solder 22, known per se, that is suitable for joining glass and metal. On the face of the spacer ring 8 carrying the metal flange 5, a peripheral recess 9 is always provided. This serves as a reservoir for overflowing glass solder so that it will not penetrate into the region of high field strength.

A stable and gastight joint is formed, also in a manner known per se, between the spacer ring 8 and the disk 1 by the use of an indium ring 10, which is encircled by a steel ring 11. The face 12 of the spacer ring 8 is inclined in such a way that there is enough room in the peripheral region for the indium ring 10 and that the spacing between the inner edge 13 of said face 12 and the inner surface of the disk 1 is minimal. The face 12 of the spacer ring 8 is provided with a conducting layer 14 which extends all the way to the inner edge 13, while a contact ring 15 conductively connects the photocathode 2 to the indium ring. Assurance is thus provided that the inner edge 13 is maintained at photocathode potential.

In the manufacture of the image intensifier, the bottom section, consisting of the disk 3 with the fluorescent screen 6 and the spacer ring 8 with the conducting layer 14, with the steel ring 11 and the indium ring 10, is produced first. The disk 1 with the photocathode 2 and the contact layer 15 is pressed into the indium ring 10 until it is as close as possible to the inner edge 13 with the conducting layer 14, which extends at least that far, or even until the conducting layers 14 and 15 make contact with each other.

Figure 3:
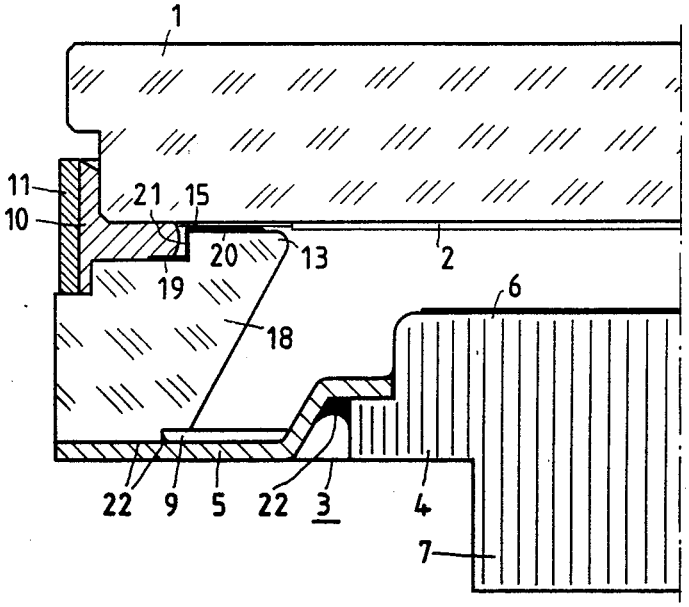
FIG. 3 shows a portion of a second preferred embodiment of the present invention.

In the embodiment illustrated in FIG. 3, the spacer ring 18 is provided with a stepped face 19 and 20. As in the embodiment of FIG. 1, an electrically conducting layer 21 connects the indium ring 10 to the inner edge 13 of the spacer ring 18. The disk 1 with the photocathode 2 and the conducting layer 15 is pressed into the indium ring 10 until it is as close as possible to the conducting layer 21, or even until the conducting layers 15 and 21 make contact with each other.

Figure 4:
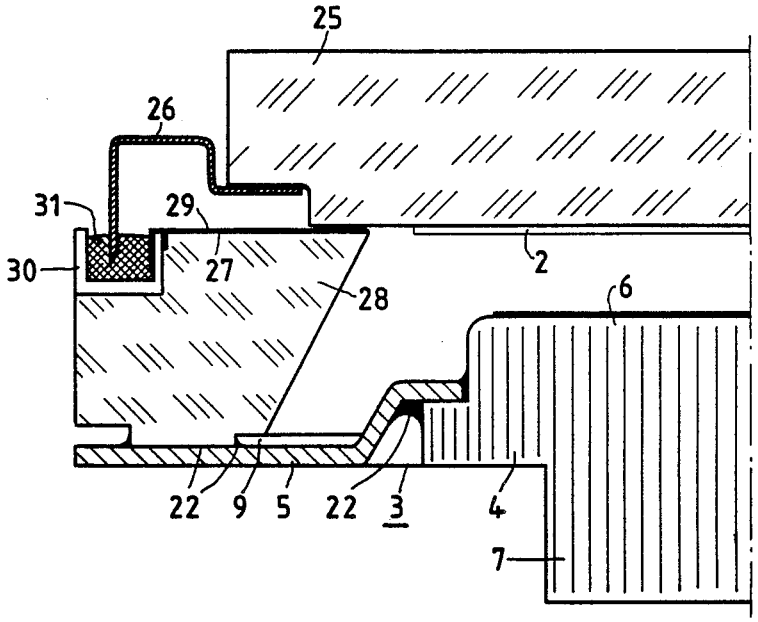
FIG. 4 shows a portion of a third preferred embodiment of the present invention.

In the embodiment illustrated in FIG. 4, the first disk 25, modified with respect to the other embodiments, is provided with a metal flange 26. The spacer ring 28 has a plane face 27 on which a conducting layer 29 has been deposited. At the periphery of the face 27, an indium ring 31 is seated in a continuous channel-section guide bar 30. When the image intensifier of FIG. 4 is assembled, the edge of the metal flange 26 is pressed or sunk into the indium ring 31.

There has thus been shown and described a novel image intensifier which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the claims will follow.

What is claimed is:

1. In an image intensifier comprising an evacuated vessel with a first disk which forms an input window and on whose inner surface a photocathode is disposed, and with a second disk which forms an output window and on whose inner surface of fluorescent screen is disposed, the spacing between the first and second disks being small in relation to the diameter of the image intensifier, the input and output windows being plane-parallel, and a spacer ring being disposed between the first and second disks whose inside diameter increases from the area of the first disk in the direction of the second disk, the improvement wherein the face of the spacer ring directed toward the first disk is provided with an electrically conductive layer.

2. The image intensifier defined in claim 1, wherein the inner surface of the first disk is planar at least within a circle formed by the inner edge of the spacer ring.

3. The image intensifier defined in claim 1, wherein the gap between the spacer ring and the first disk decreases from the exterior to the interior.

4. The image intensifier as defined in claim 3, wherein an indium ring is provided at the periphery of the spacer-ring face directed toward the first disk for uniting the spacer ring with the first disk.

5. The image intensifier as defined in claim 4, wherein a continuous groove is provided at the periphery of the face of the spacer ring directed toward the first disk for accommodation of the indium ring.

6. The image intensifier defined in claim 4, wherein the indium ring further encircles portions of the outer surfaces of the first disk and the spacer ring and is itself encircled by a steel ring.

7. The image intensifier defined in claim 4, wherein the face of the spacer ring directed toward the first disk extends substantially plane-parallel to the photocathode; wherein the first disk is united in its peripheral region with a metal flange comprising an annular edge which axially projects beyond the plane of the photocathode; and wherein the edge of the metal flange is pressed into the indium ring.

8. The image intensifier defined in claim 5, wherein the peripheral groove is formed by a metal channel.

9. The image intensifier defined in claim 1 wherein the second disk is formed by a glass body which forms the output window and is radially surrounded by a further metal flange which is radially offset in such a way that the spacing between said further metal flange and the plane of the photocathode is greater than the spacing of the fluorescent screen from the photocathode.

10. The image intensifier defined in claim 9, wherein a continuous radial recess is provided internally in the face of the spacer ring which is joined to said further metal flange.

11. The image intensifier defined in claim 1 wherein the spacer ring is made of an electronically conducting glass.

12. The image intensifier defined in claim 1, wherein the spacer ring comprises an electrically weakly conducting surface on its inside.

13. The image intensifier defined in claim 3, wherein the gap between the spacer ring and the first disk decreases from the exterior to the interior substantially linearly.

14. In an image intensifier comprising an evacuated vessel with a first disk which forms an input window and on whose inner surface a photocathode is disposed, and with a second disk which forms an output window and on whose inner surface of fluorescent screen is disposed, the spacing between the first and second disks being small in relation to the diameter of the image intensifier, the input and output windows being plane-parallel, a spacer ring being disposed between the first and second disks whose inside diameter increases from the area of the first disk in the direction of the second disk and an indium ring disposed between the spacer ring and first disk for uniting the spacer ring and first disk together;

the improvement comprising an electrically conductive contact layer, electrically connected to said photocathode, disposed on the inner surface of the first disk surrounding said photocathode and electrically and physically connected with the spacer ring at least at the inside diameter of the spacer ring.

15. The image intensifier defined in claim 14, wherein the face of the spacer ring directed toward the first disk is provided with an electrically conducting layer.

16. The image intensifier defined in claim 14, wherein the inner surface of the first disk is planar at least within a circle formed by the inner edge of the spacer ring.

17. The image intensifier defined in claim 14, wherein a gap between the spacer ring and the first disk decreases from the indium ring to the interior.

18. The image intensifier defined in claim 17, wherein the gap between the spacer ring and the first disk decreases from the indium ring to the interior substantially linearly.

19. The image intensifier defined in claim 17, wherein the indium ring is provided at the periphery of the face of the spacer ring directed toward the first disk.

20. The image intensifier defined in claim 19, wherein a continuous groove is provided at the periphery of the face of the spacer ring directed toward the first disk for accommodation of the indium ring.

21. The image intensifier defined in claim 19, wherein the indium ring further encircles portions of the outer surfaces of the first disk and the spacer ring and is itself encircled by a steel ring.

22. The image intensifier defined in claim 14, wherein the face of the spacer ring directed toward the first disk extends substantially plane-parallel to the photocathode; wherein the first disk is united in its peripheral region with a metal flange comprising an annular edge which axially projects beyond the plane of the photocathode; and wherein the edge of the metal flange is pressed into the indium ring.

23. The image intensifier defined in claim 22, wherein the peripheral groove is formed by a metal channel.

24. The image intensifier defined in claim 14, wherein the second disk is formed by a glass body which forms the output window and is radially surrounded by a further metal flange which si radially offset in such a way that the spacing between said further metal flange and the plane of the photocathode is greater than the spacing of the fluorescent screen from the photocathode.

25. The image intensifier defined in claim 24, wherein a continuous radial recess is provided internally in the face of the spacer ring which is joined to said further metal flange.

26. The image intensifier defined in claim 14, wherein the spacer ring is made of an electronically conducting glass.

27. The image intensifier defined in claim 14, wherein the spacer ring comprises an electrically weakly conducting surface on it inside.

28. The image intensifier defined in claim 3, wherein the gap between the spacer ring and the first disk decreases from the exterior to the interior substantially linearly.

* * * * *